US005366220A

United States Patent [19]

Harper

[11] Patent Number: 5,366,220

[45] Date of Patent: Nov. 22, 1994

[54] BALL AND MALLET GAME DEVICE

[76] Inventor: M. Deane Harper, 218 22nd St., Dunbar, W. Va. 25064

[21] Appl. No.: 73,048

[22] Filed: Jun. 8, 1993

[51] Int. Cl.[5] ..... A63F 9/00

[52] U.S. Cl. ..... 273/138 R; 273/146; 273/83; 273/58 F; 273/58 B

[58] Field of Search ..... 273/146, 145 C, 145 R, 273/83, 58 F, 58 B, 58 H, 138 R

[56] References Cited

FOREIGN PATENT DOCUMENTS 870967 3/1953 Germany ..... 273/146

*Primary Examiner*—Benjamin H. Layno

*Attorney, Agent, or Firm*—Jacobson, Price, Holman & Stern

[57] ABSTRACT

A game device including a hollow, transparent plastic ball that is struck by a mallet having soft, resilient striking surfaces and an elongated centrally disposed handle with the mallet being swung in a manner to strike the ball to drive it along a ground surface in a manner similar to croquet. The clear, transparent plastic ball is provided with a block freely movable within the interior of the ball with each face of the block being provided with instructional indicia. After the ball has been struck by the mallet and ceases to roll, the upwardly facing face of the block provides instructions for the next playing sequence. The blocks may be constructed of cardboard or plastic material and may be various shapes including square, hexagonal, pentagonal or octagonal which enables many different types of games to be played in accordance with the selection of instructional indicia to be placed on the faces of the block.

5 Claims, 1 Drawing Sheet

BALL AND MALLET GAME DEVICE

BACKGROUND OF THE INVENTION

1. Field of the Invention

The present invention generally relates to a game device and more specifically to a game device utilizing a hollow, transparent plastic ball that is struck by a mallet having soft, resilient striking surfaces and an elongated centrally disposed handle with the mallet being swung in a manner to strike the ball to drive it along a ground surface in a manner similar to croquet. The clear, transparent plastic ball is provided with a cubical block freely movable within the interior of the ball with each face of the block being provided with instructional indicia. After the ball has been struck by the mallet and ceases to roll, the upwardly facing face of the block provides instructions for the next playing sequence. The blocks may be constructed of cardboard or plastic material and may be various shapes including square, hexagonal, pentagonal or octagonal which enables many different types of games to be played in accordance with the selection of instructional indicia to be placed on the faces of the block.

2. Description of the Prior Art

Various games have been devised in which a ball is struck by a bat or mallet in order to project the ball in a desired path. Balls have been provided with various indicia located externally or internally thereof and various types of mallets have been provided to strike the ball and roll it along a ground surface towards a target or series of targets, such as the well known game of croquet. The following U.S. patents relate to development in this field of endeavor.

U.S. Pat. No. 1,166,946
U.S. Pat. No. 2,219,154
U.S. Pat. No. 2,944,823
U.S. Pat. No. 3,655,197
U.S. Pat. No. 4,448,418

While the above patents disclose a unique mallet and various ball structures, none of them disclose the specific ball structure combined with the specific mallet structure of this invention.

SUMMARY OF THE INVENTION

An object of the present invention is to provide a game device incorporating a ball and a mallet for striking the ball and causing it to roll along a ground or other supporting surface in a desired direction toward a desired target in which the ball is a transparent, hollow, clear plastic member and the mallet includes a generally cylindrical member that is swung in an arcuate path by the use of an elongated centrally disposed handle with a soft, resilient striking face at each end of the cylindrical member with the overall configuration of the mallet being similar to a croquet mallet but with the striking faces thereof being soft and resilient.

Another object of the invention is to provide a game device in accordance with the preceding object in which the clear transparent hollow ball is of rigid construction and provided with an interiorly disposed block having a maximum dimension substantially less than the diameter of the ball in order to enable the block to move freely, roll and tumble while the ball is rolling and come to rest along with the ball with one face or surface of the block facing upwardly.

A further object of the invention is to provide a game device in accordance with the preceding objects in which the block is provided with instructional indicia inscribed on each face thereof in order to provide instructions for the next play of a game with various instructional indicia being provided on the block to enable various games to be played with the instructional indicia being readily observable when it is facing upwardly and when observed through the transparent clear plastic ball.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 3:
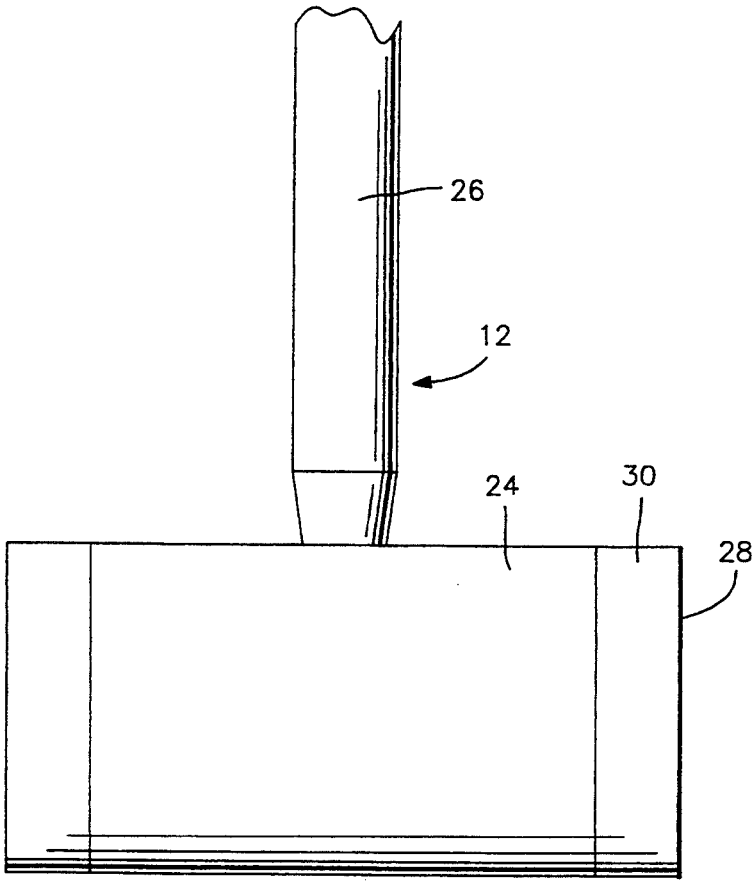
FIG. 3 is a side elevational view of the mallet used to strike the ball for rolling it along a supporting surface.
Figure 1:
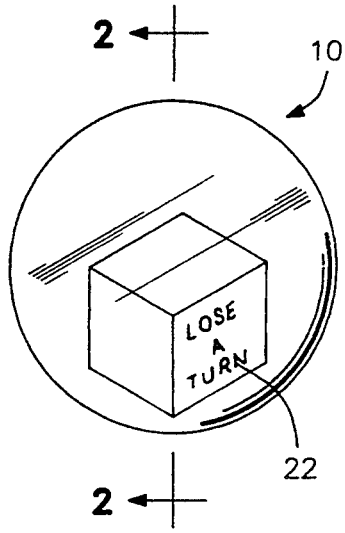
FIG. 1 is a perspective view of the ball with the interior block of the present invention illustrated therein.
Figure 2:
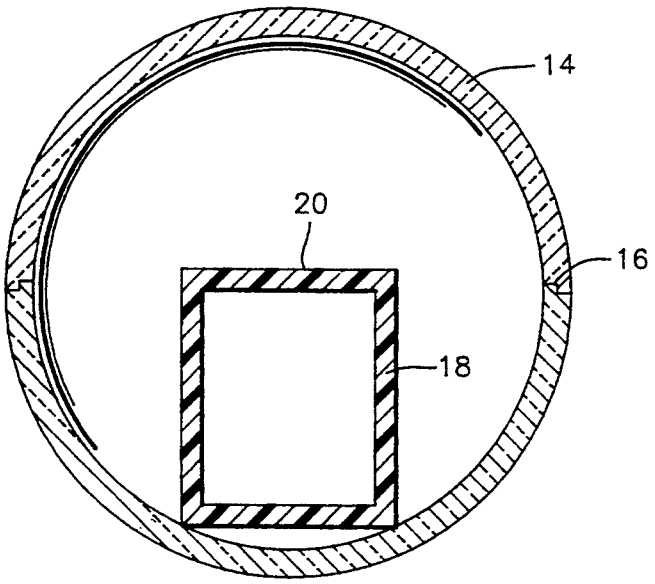
FIG. 2 is a vertical sectional view, on an enlarged scale, taken substantially upon a plane passing along section line 2—2 on FIG. 1 illustrating the structural details of the ball and the block and illustrating the size relationship therebetween.

Referring now specifically to the drawings, the spherical ball forming a part of this invention is generally designated by reference numeral 10 and is illustrated in detail in FIGS. 1 and 2 and the mallet is generally designated by reference numeral 12 and is illustrated in FIG. 3 of the drawings.

The ball 10 includes a rigid spherical shell 14 constructed of transparent, clear plastic material with the ball being constructed of two semispherical components joined together along a juncture 16 as illustrated in FIG. 2.

Positioned interiorly of the spherical ball or shell 14 is a block 18 having a plurality of flat faces or surfaces 20 each of which is provided with indicia 22 printed or otherwise inscribed thereon with the indicia 22 providing instructions relating to the next play of a game with the face 20 which is oriented upwardly when the ball and block come to rest providing instructions for the next play of a game. As illustrated, the major dimension of the block 18 is substantially less than the internal diameter of the ball 14 to enable the block to roll and tumble freely within the interior of the ball as the ball rolls along a supporting surface with the block coming to rest along with the ball with one surface 20 facing upwardly. The ball may be constructed of rigid plastic material such as polystyrene, polyethylene and the like and the block may be constructed of a hollow cardboard member, hollow plastic member or a solid wood or plastic member with the indicia 20 printed on the surface, painted on the surface or otherwise applied thereto with the block being placed in the ball before the two semispherical components are joined along the juncture line 16.

The mallet 12 is illustrated in detail in FIG. 3 and includes a cylindrical member 24 having an elongated handle 26 extending therefrom in perpendicular relation with the handle fixedly secured to the cylindrical member. Each end of the cylindrical member includes a striking face 28 formed by a cylindrical body of soft resilient material 30. The configuration of the mallet 12 is quite similar to a conventional croquet mallet with the difference between a croquet mallet and the present invention being the soft resilient members 30 which forms a soft resilient striking face 28 on both ends of the cylindrical member 24.

Various types of games may be employed by utilizing the hollow spherical ball of clear transparent material and a freely moveable block within the ball having a plurality of flat surface segments with each surface segment having instructional indicia thereon to provide instructions to the player to follow during the next sequence of play. The block preferably is relatively lightweight which may be obtained by using a hollow block in order to reduce the degree of retardation of rolling movement of the ball after it has been struck by the mallet. The ball and mallet may be used with target devices on the supporting surface or attached to the supporting surface which may, in some instances, include target areas somewhat similar those used in croquet.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A game device comprising a hollow spherical ball constructed of rigid, transparent material to enable observation of the interior of the ball, a block oriented interiorly of the ball and being freely moveable therein with the major external dimension of the block being substantially less than the internal diameter of the ball to enable the block to roll and tumble as the ball rolls along a supporting surface, said block including a plurality of flat external surface areas and indicia on at least one surface area of the block to enable observation of the indicia when the ball comes to rest with the indicia providing instructions for subsequent game play, and a mallet for striking the ball, said mallet including a generally cylindrical body member having a laterally extending handle attached thereto, said body member including a soft, resilient member on each end thereof to provide a soft resilient engagement with the ball for projecting the ball in a desired direction toward a target.

2. The game device as defined in claim 1 wherein said block has indicia on each flat surface area thereof with the indicia on the uppermost surface area of the block when the ball and block come to rest providing instructional indicia for subsequent game play.

3. The game device as defined in claim 1 wherein said block flat surface areas are of equal dimension and being of a symmetrical shape selected from square, hexagonal, pentagonal and octagonal.

4. The game device as defined in claim 1 wherein said block is of hollow construction to reduce retardation of rolling movement of the ball.

5. The game device as defined in claim 1 wherein said ball is constructed of rigid plastic material and including two semispherical components joined together to form a hollow sphere thereby enabling the block to be positioned within the ball.

* * * * *